United States Patent [19]

Thomsen

[11] 4,096,775

[45] Jun. 27, 1978

[54] METHOD OF CUTTING WRAPPERS FOR TOBACCO PRODUCTS AND CUTTING TABLE FOR CARRYING OUT SAID METHOD

[75] Inventor: Jorgen Thyrsted Thomsen, Fredericia, Denmark

[73] Assignee: J. P. Schmidt Jun. A/S, Fredericia, Denmark

[21] Appl. No.: 764,873

[22] Filed: Feb. 2, 1977

[30] Foreign Application Priority Data

Feb. 5, 1976 Denmark ..... 481/76

[51] Int. Cl.[2] ..... B26D 1/02

[52] U.S. Cl. ..... 83/511; 83/24; 83/55

[58] Field of Search ..... 83/509, 510, 24, 55, 83/511, 512

[56] References Cited

U.S. PATENT DOCUMENTS 3,695,132 10/1972 Cuir et al. ..... 83/509 X 3,939,740 2/1976 Johnson ..... 83/24

FOREIGN PATENT DOCUMENTS 46,747 1/1933 Denmark.

1,003,729 9/1965 United Kingdom.

*Primary Examiner*—Willie G. Abercrombie

*Attorney, Agent, or Firm*—Finnegan, Henderson, Farabow & Garrett

[57] ABSTRACT

A cutting table having a suction chamber and operable to retain tobacco leaves thereon. A plurality of knives are located adjacent the table, and the knives and table are movable relative to one another so that the knives can be exposed above the surface of the table. A pressure device is positionable over the table and is cooperable with the exposed knives to cut tobacco leaves. The knives are located with respect to one another so that in the method of cutting wrappers from tobacco leaves, consecutive cutting operations can be performed after displacing the tobacco leaf but while maintaining the same orientation of the stem of the leaf.

3 Claims, 5 Drawing Figures

Figure 1:
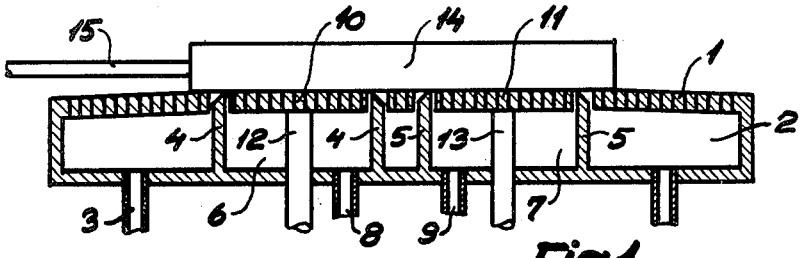

METHOD OF CUTTING WRAPPERS FOR TOBACCO PRODUCTS AND CUTTING TABLE FOR CARRYING OUT SAID METHOD

Cutting of wrappers for cigars, cigarillos or cheroots usually takes place on a cutting table having a forming knife corresponding to the desired configuration of the wrapper. In this operation a tobacco leaf is spread over the cutting table and a cylinder is passed over the leaf to depress it against the sharp edges of the forming knife, whereby the desired wrapper is cut. Now this wrapper is removed from the cutting table by means of a suction device and transferred to a so-called finishing machine where the wrapper is wound about a preformed core known as a bunch into a cheroot or cigar. The present invention actually is not concerned with this finishing process itself, but it should be noted that the object of the invention is to accomplish a rationalized and accelerated operation in cutting wrappers, while maintaining the highest quality possible, which includes the desirability of causing as far as possible the same side, preferably the top side of the tobacco leaf to be faced outwardly after applying the wrapper. In this context it is also important, in order to obtain high-quality tobacco products of this type, to take care that after finishing the side ribs of the tobacco leaf are oriented as far as possible lengthwise of the product as you will otherwise have an unsightly appearance coupled with the risk of the wrapper breaking because of the difficulty in bending the somewhat stiffer side ribs as much as necessary if they should happen to be oriented transversely of the tobacco product.

In the cutting process itself, as it has been performed heretofore, the operation is required to position the leaf over the forming knife of the cutting table in a proper manner, i.e. partly to obtain correct orientation of the ribs and partly so as to obtain optimum utilization of the tobacco leaf, there being usually made two or three cuts in each side of a leaf. However, a tobacco leaf may often have holes or other defects, and the operator has to watch this and take care to position the leaf so that there will be no holes in the sections cut for use as wrappers, for which reason you cannot as a matter of course — which might otherwise seem fairly obvious and has also been attempted — arrange two or more simultaneously operating forming knives on a cutting table because you cannot be certain that two or possibly more cuts should be laid every time in the same way in relation to each other as this is decided by the operator while working the apparatus with a view to the size, shape and possible defects of the tobacco leaf.

It is all these numerous complicated problems bound up with the irregularity of the natural product which have always rendered the cutting operation itself both costly and time-consuming because the manual supervision and evaluation of the individual tobacco leaf and the said manual handling of the leaf are absolutely vital to obtain a high-quality tobacco product. The object of the present invention is to provide a method of cutting wrappers for cigars, cigarillos or cheroots in which the cutting is effected by means of a cutting table having at least two forming knives, and to provide a method that will considerably accelerate the work connected with this cutting, and according to the invention, this is achieved by employing a cutting table whose forming knives are arranged off the same operating position and adapted to be actuated separately, where the tobacco leaf after each cutting operation with a forming knife is moved to the cutting position of the second forming knife by displacement across the cutting table, the leaf being gripped by or proximate its leading edge in the direction of displacement.

The substantial gain in time achieved by using such a method is due to the very short movements of the tobacco leaf required unlike the methods practiced heretofore where it was necessary for each cut to grip the tobacco leaf, lift it way from the cutting table and put it down again in the position required for the next cut. The fact is that it is of vital importance that the leaf should be completely smooth for the punching operation, and this is not possible in the heretofore known methods without performing the above described operation. When, however, as in the method according to the invention it is sufficient to cause the leaf to be pulled forward from one cutting position to the next, the leading edges in the direction of movement of the cuts already made will not be adversely affected. The turn-up of the opposite edge of such a cut, which may happen during displacement across the cutting table, is rendered totally insignificant, which eliminates the risk of poor cuts and prevents less economic cutting of the leaf.

When cutting wrappers it has been customary to divide the tobacco leaf prior to the cutting operation, which is specifically due to the fact that cutting in relation to the leaf structure must be made in such a manner that in the finishing operation the side ribs of the leaf are caused to be oriented lengthwise of the tobacco product. This means that it is usually necessary to employ two different finishing devices, to the effect that the wrapper cut from one side of the leaf is given a right-hand winding, while a wrapper from the other side of the leaf requires a left-hand winding.

In the manufacture of inexpensive cheroots attempts have been made to cut the wrappers from undivided tobacco leaves, which is also possible by employing the claimed method but does not automatically prevent the back of the leaf from being faced outwardly in half the cheroots, while the top side is faced outwardly in the other half. Also, additional manipulations with the leaf are necessary to get the proper rib orientation.

The invention is further aimed at an embodiment of the subject method in which cutting is made from undivided tobacco leaves without involving the above disadvantages, and according to the invention, this is achieved by employing a cutting table whose forming knives are arranged in pairs so that one forming knife of one pair is adapted to cut from one side of a tobacco leaf and the second forming knife is adapted to cut from the other side, and where the displacement of the tobacco leaf is to the effect that the cuts are substantially made alternately from either side of the tobacco leaf. It has been found that cutting in this manner will result in the operator, who works such a cutting device, obtaining at least a 50% saving in time.

The fact that whole tobacco leaves are cut means an additional saving in the overall manufacturing process as it is not necessary beforehand to divide the leaves and remove their midrib as was required heretofore to be in a position always to cause the top side of the leaf to face outwardly in the finished tobacco product, but owing to the above mentioned arrangement of the forming knives it is achieved that even when cutting from both halves of an undivided leaf it is possible in all cases to have the top side faced outwardly.

According to the invention, it will usually be advantageous to carry out the method whereby the first cut from a tobacco leaf is made close to its main rib, which will specifically result in this rythmic reciprocation of the tobacco leaf which with very limited movements enables the operator to perform such cuts much faster than heretofore possible, and you are therefore in a position to apply this special technique so as to fully utilize two finishing apparatus for receiving the wrappers cut according to the claimed method, i.e. a right-hand and a left-hand finishing machine.

The invention further relates to a cutting table for carrying out the above method, and according to the invention, such a cutting table is characterized by including at least two forming knives adapted to be actuated separately and which are spaced so closely and arranged with a view to the position of the acute lobes in such relationship to each other that displacement of a tobacco leaf from one cutting position to another is possible while maintaining the stem orientation of the leaf. This affords the possibility of performing cuts in rapid succession as only very limited movements of the tobacco leaf are required between cutting operations. In carrying out the claimed method of cutting wrappers from undivided tobacco leaves it is necessary to employ a cutting table of the type described which, according to the invention, is further characterized by including at least one pair of forming knives adapted to be used separately and so arranged with a view to the position of the acute lobes that one forming knife of one pair may serve to cut from one side of the tobacco leaf, and the other forming knife may serve to cut from the other side of the tobacco leaf, while maintaining the stem orientation thereof. The shape of a wrapper usually approximates a parallelogram, one pointed end of which has a projecting lobe, the so-called acute lobe, which specifically serves to form the end of the tobacco product as the finishing operation is completed. This acute lobe may either face the stem of the leaf and then be at the side of the wrapper furthest away from the main rib of the tobacco leaf or may be faced away from the stem of the leaf and be at the side of the cut closest to the main rib of the leaf. Naturally, this applies to both cuts involved, i.e. the cut to be made from one side of the leaf and the cut to be made from the other side. The two forming knives are therefore arranged in opposed relationship and may, for example, be symmetrically disposed in relation to the main rib if the acute lobes are identically oriented. The two forming knives may also have the acute lobes oppositely oriented, which leaves out any proper symmetry, but the two forming knives nevertheless constitute a pair designed to be used so that one forming knife will cut from one side of the leaf and the other forming knife from the other side.

Figure 2:
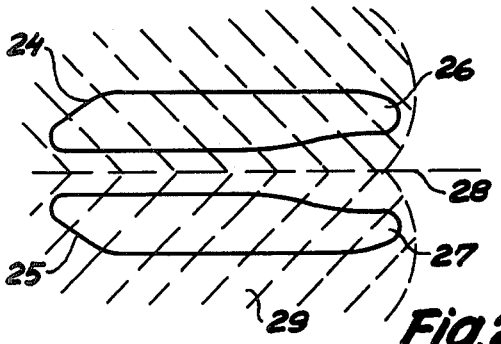
Figure 3:
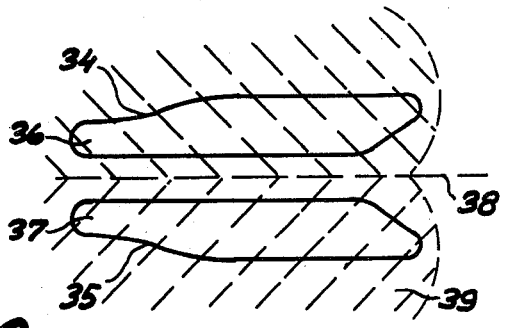
Figure 4:
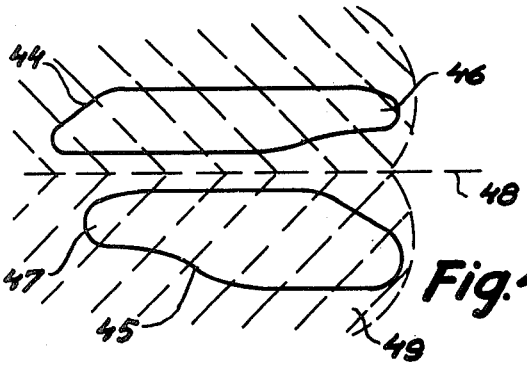
Figure 5:
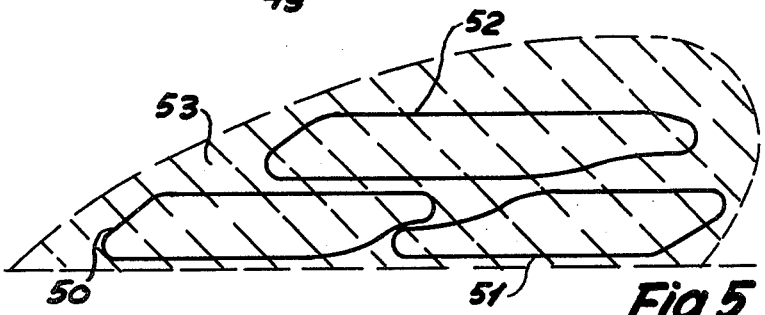

The design of the cutting table will appear in greater detail from the subsequent explanation, the invention, including the method, being further explained in connection with the drawings, in which FIG. 1 in schematic form shows a vertical section of an embodiment of a cutting table according to the invention, FIGS. 2–4 show various positions of pairs of forming knives for carrying out the method according to the invention, especially for cutting undivided tobacco leaves, and FIG. 5 shows a particularly advantageous position of forming knives for cutting divided tobacco leaves.

FIG. 1 shows a cutting table consisting of a perforated surface 1 forming the top side of a suction chamber 2 which is connected to a vacuum supply line 3. The chamber 2 accommodates two forming knives 4 and 5 each defining a smaller suction space 6 and 7 respectively connected to vacuum supply lines 8 and 9 respectively. The sections of the cutting table disposed within the areas defined by the knives 4 and 5 are designated 10 and 11 respectively, and these are supported by columns, 12 and 13 respectively, by means of which the sections 10 and 11 can be moved upwards and downwards. Above the cutting table 1 there is provided a cylinder 14 having a shaft 15 extending beyond the cutting table, and by means of which the cylinder 14 can be moved across the cutting table for cutting the wrappers as the sections 10 and 11 may alternately be lowered a little, whereby the knives 4 and 5 respectively are actuated to perform the cutting. The two columns 12 and 13 can be controlled in any expedient manner as is known from cutting tables of the conventional type, in that it should preferably be possible to manipulate the two columns individually to obtain separate operation of the forming knives. At the same time the vacuum supply is controlled so as to retain the tobacco leaf during the cutting operation, but after completion of the latter, the sections 10 and 11 may be raised above the remaining surface of the cutting table, and as the vacuum supply to the space 6 or 7 is disconnected, the cut wrapper may be removed from the cutting table in any known manner, which is usually by means of a suction device adapted to transfer cut wrapper to a finishing apparatus. The latter will not be further discussed here as it forms no part of the invention. It will thus be appreciated that it is possible to provide alternate cutting from either side of a tobacco leaf by actuating either one or the other chamber 6 or 7 and the associated sections of the cutting table, viz. 10 and 11, and the said means may be controlled in any expedient manner which will not be further discussed here as such control is known from the apparatus employed heretofore.

FIG. 2 shows schematically a suggested arrangement of a pair of forming knives on the cutting table, i.e. the two forming knives designated 24 and 25, which may both have a configuration of proximating a parallelogram where one pointed end has an extension corresponding to the acute lobe of the wrapper to be cut. These extensions are designated 26 and 27 respectively and are disposed so as to face the stem end 28 of the tobacco leaf 29 partly indicated in dash line. By successively cutting with these two forming knives it will be evident that only relatively little displacement of the leaf is required, it being possible, of course, to make as usual a number of cuts next to each other and also to make additional cuts closer to the edge of the leaf after making the first cuts close to the main rib 28. One of the wrappers cut will lend itself to right-hand winding and the other to left-hand winding about the respective bunch, but in either case the top side of the leaf will be faced outwardly.

FIG. 3 shows a different arrangement of knives 34 and 35 as it will be noted that in this case the acute lobes 36 and 37 are faced away from the stem end 38 of the leaf 39, being closer to the main rib of the leaf, which will result in a cut which as regards the position of the side ribs of the leaf is quite similar to the cut-outs appearing from FIG. 2.

FIG. 4 shows yet another embodiment with one forming knife 44 arranged as indicated in FIG. 2 and the second forming knife 45 arranged as indicated in FIG. 3. Whilst in the embodiments indicated in FIGS. 3 and 4 it is a question of symmetrical arrangement of the two forming knives, there is no symmetry involved in the embodiment of FIG. 5, because the two forming knives are oppositely arranged, their function being, however, the same and likewise resulting in two wrappers, one of which lends itself to right-hand winding and the other one to left-hand winding. This is due to the fact that the acute lobe 46 of the knife 44 faces the stem end 48 of the leaf 49 away from the main rib of the leaf, while the acute lobe 47 of the knife 45 is faced away from the stem end 48, being close to the main rib of the leaf. It should further be noted that these two forming knives 44 and 45 are neither of identical configuration nor of identical size. This may be advantageous as it becomes possible to use such cuts for transferring wrappers to finishing apparatus giving two different sizes of cheroots or cigars, whereby one size will have a right-hand winding and the other a left-hand winding.

It should be noted that the configuration of the forming knives actually has no bearing on the invention, it being merely their arrangement with respect to each other and in relation to the tobacco leaf to be cut which is important, as care must be taken all the time that each of the two forming knives of a pair should be designed for cutting from one or the other side of a tobacco leaf, and it should be arranged to obtain the correct position of the side ribs with a view to the finishing operation. The configuration of the cutting table itself and the control of the various means thereof, naturally, could vary within the scope of the invention, it being also in such case only the positioning of the two forming knives of a pair which is vital to the achievement of the advantages explained above in connection with carrying out the method.

The above description of the apparatus and the method according to the invention is basically aimed at the specific embodiment in which undivided tobacco leaves are cut, but FIG. 5 shows an arrangement of forming knives suitable for cutting wrappers from a divided leaf, i.e. from one side of such leaf. This embodiment includes three forming knives 50, 51 and 52, being all disposed to give proper orientation of the ribs with respect to the finishing operation. These three forming knives are arranged in close relationship and so as to be substantially within an area corresponding to the shape of one half of a tobacco leaf 53. However, it is not possible to work these three knives simultaneously in view of the problems explained above with regard to the configuration and possible defects of the leaves, but it will be evident that after each cut only very little displacement is required to obtain proper positioning of each individual cut, and such an arrangement therefore lends itself to very fast operation. In the figure the leaf 53 is the "right-hand side" and for cutting the corresponding "left-hand side" it is necessary to employ a different arrangement of the forming knives, these being reversed to cause the top side of the leaf to be faced outwardly when wound in the opposite direction and with the rib properly oriented.

What we claim is:

1. A cutting device for cutting wrappers for cigars, cigarillos or cheroots from tobacco leaves, said device including a cutting table, a plurality of cutting knives having cutting edges adjacent said table, said cutting edges of each of said knives defining a contoured shape desired for a wrapper with an acute lobe at one end thereof, said table and said knives being movable relative to one another to position said edges in a first position withdrawn from said table, said table and said knives being operable to position said knives in said first position independently of one another, pressure means movable relative to said table and knives and cooperable with said knife edges when said knives are in said first position to cut tobacco leaves, said knives being positioned relative to one another so that consecutive operations can be performed on a tobacco leaf after displacement of said leaf while maintaining the same orientation of the stem of the leaf.

2. A cutting device as defined in claim 1, which includes at least one pair of knives, a first knife of said pair being arranged for cutting a tobacco leaf on a first side of the stem thereof, and a second knife being arranged for cutting said tobacco leaf on the opposite side of said stem.

3. A cutting device as defined in claim 1 which includes a plurality of pairs of knives, said table and said knives of each of said pairs being operable to position each of said knives in said first position independently of each other.

* * * * *